United States Patent [19]

Bogese, II

[11] 4,135,336

[45] Jan. 23, 1979

[54] PLASTIC GUY WIRE GUARD AND METHOD OF MAKING AND USING SAME

[75] Inventor: Stephen B. Bogese, II, Roanoke, Va.

[73] Assignee: Virginia Plastics Company, Roanoke, Va.

[21] Appl. No.: 753,871

[22] Filed: Dec. 23, 1976

Related U.S. Application Data

[63] Continuation-in-part of Ser. No. 625,385, Oct. 24, 1975, Pat. No. 3,999,340.

[51] Int. Cl.[2] ..... E04H 12/20

[52] U.S. Cl. ..... 52/147; 52/741

[58] Field of Search ..... 52/147, 741; 138/99, 138/156, 177; 174/DIG. 8

[56] References Cited

U.S. PATENT DOCUMENTS

| | | | |
|---|---|---|---|
| 3,852,517 | 12/1974 | Fava | 174/DIG. 8 |
| 3,899,807 | 8/1975 | Sovish et al. | 52/147 X |
| 3,949,110 | 4/1976 | Nakajima et al. | 174/DIG. 8 |
| 3,958,379 | 5/1976 | Williams et al. | 52/147 |
| 3,999,340 | 12/1976 | Bogese et al. | 52/147 |

*Primary Examiner*—Price C. Faw, Jr.
*Assistant Examiner*—Carl D. Friedman
*Attorney, Agent, or Firm*—Berman, Aisenberg & Platt

[57] ABSTRACT

A plastic guy wire guard which is comprised of a pair of substantially cylindrical tubular portions which are integrally joined to one another by a rapidly tapering neck portion. The design achieves substantial material savings and features a universal single sized guard for installation over any of a plurality of differently sized guy wires and associated anchor assemblies. The plastic guard may be manufactured in a continuous process which features imparting a memory characteristic to the smaller diameter portion of the guard. Upon installation, the larger diameter portion is caused to contract as a means for securing the guard to the anchor. Contraction may be caused by application of heat, either via the sun or a portable source.

17 Claims, 4 Drawing Figures

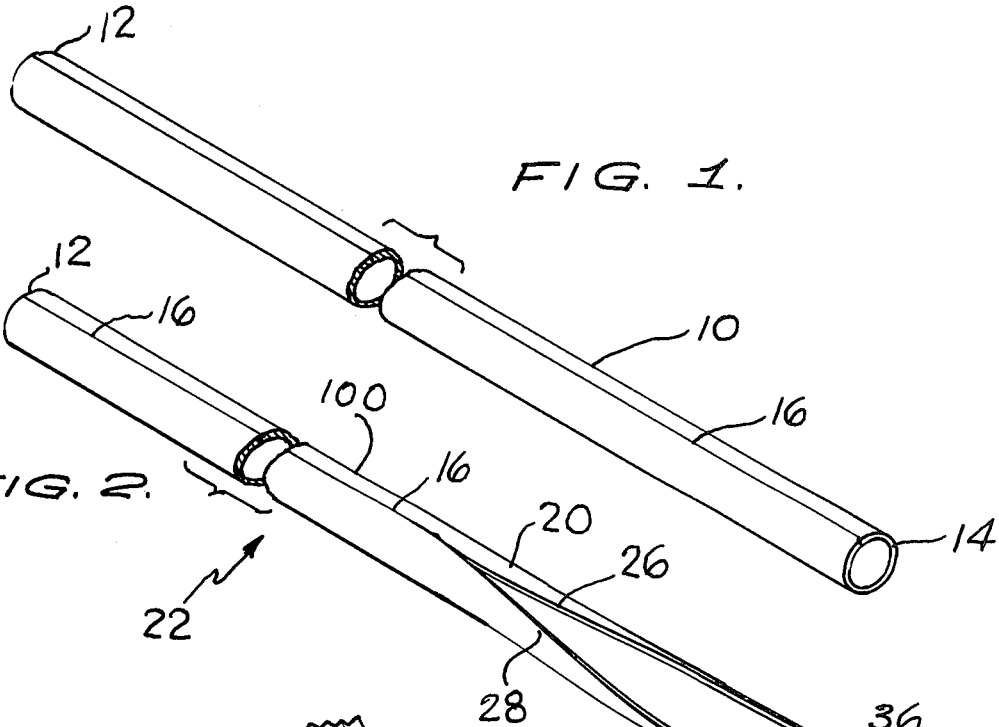
FIG. 1.
FIG. 2.
FIG. 3.
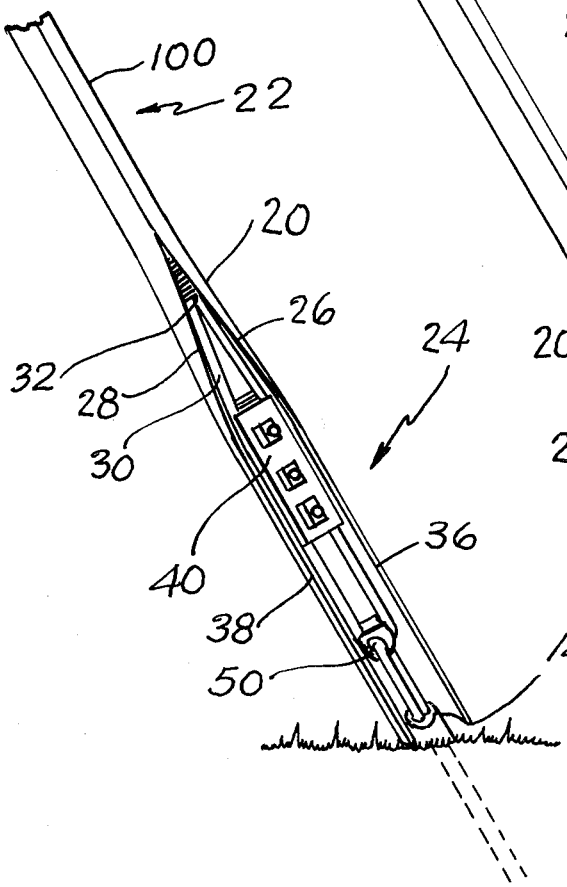
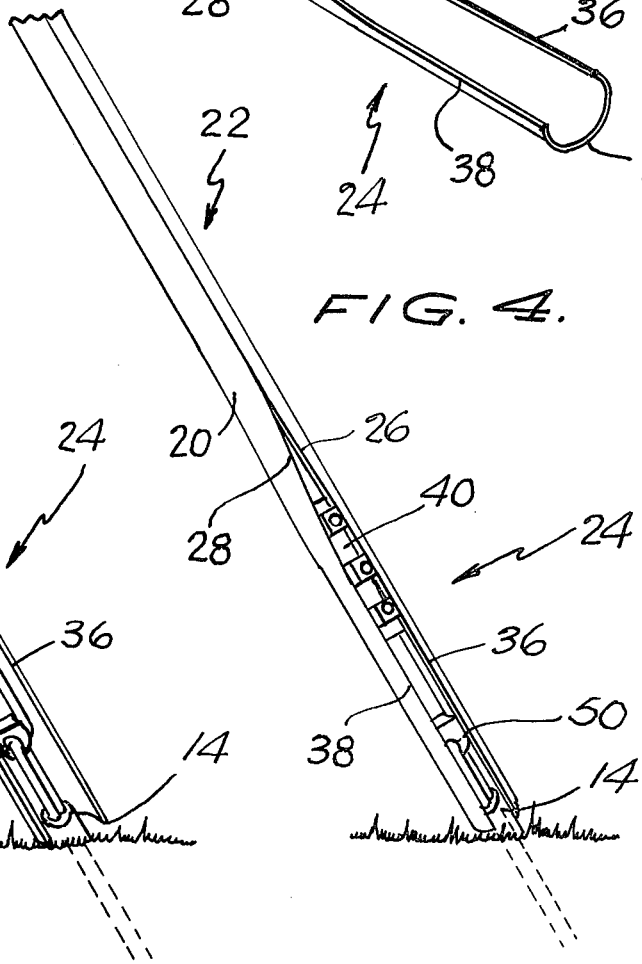
FIG. 4.

PLASTIC GUY WIRE GUARD AND METHOD OF MAKING AND USING SAME

CROSS-REFERENCE TO RELATED APPLICATION

This application is a continuation-in-part patent application of Ser. No. 625,385 filed Oct. 24, 1975, now U.S. Pat. No. 3,999,340 issued Dec. 28, 1976.

BACKGROUND OF THE INVENTION

1. Field of the Invention

The present invention is related to guy wire guards and, more particularly, is directed towards a novel rigid plastic guy wire guard, as well as a method for manufacturing same and a technique for installing the guard on a guy wire installation.

2. Description of the Prior Art

Many designs have been previously suggested for constructing guy wire guards or protectors. Several prior art United States Patents in this general area of which I am aware include: U.S. Pat. Nos. 1,950,917; 1,995,503; 1,996,871; 2,061,306; 2,880,828; and 3,010,546.

Unfortunately, I have found that each of the designs set forth in the above-cited patents suffer from one or more deficiencies. Perhaps one of the more serious of the deficiencies of the prior art designs involves substantial material waste. In today's manufacturing processes, efficient productivity depends upon automation, high volume, and minimum material waste. This is particularly true in cases where large quantities of a product are being manufactured, and where a small savings in material for each product will result in a substantial savings for the manufacturing process as a whole.

The Phillips and Skubal patents (U.S. Pat. Nos. 3,010,546 and 2,880,828) are each illustrative of typical prior art guy wire guards which clearly evidence substantial material waste. The Phillips patent, for example, illustrates in FIG. 1 a relatively large and uniform diameter guy wire tube 15 which is clearly much larger than is necessary to encompass the relatively small diameter guy wire 12 therein. The large diameter guy guard is provided due to the requirement that it encompass the anchor assemblies formed at both ends of the guy wire. The Skubal patent, in FIG. 2, is particularly instructive in this regard in that the lower portion of the guy guard is illustrated as being just sufficient to accommodate a parallel groove clamp 11 for securing the guy wire 2; however, the upper portion of the same guard is of the same diameter, and FIG. 2 clearly illustrates the inherent material waste in such a design.

The design described in the Hocher, et al. patent (U.S. Pat. No. 2,061,306), while illustrating a continuously tapered plastic tube 7, nevertheless suffers from a considerable amount of material waste near the small diameter upper portion of the guy wire. Further, the irregular shape of the blank from which Hocher's tube 7 is formed does not lend itself to continuous mass production, and is therefore inefficient to manufacture.

Several older U.S. Patents (Lemont U.S. Pat. No. 1,996,871 and Elliott U.S. Pat. No. 1,995,503) set forth metallic guy wire guards which include enlarged end portions for accommodating the guy wire clamp or anchor assemblies. However, each of the devices described in these patents have been rendered obsolete by present day technology with its emphasis towards much less expensive plastic guy wire guards that can be mass produced by extrusion or molding processes. The prior art technique of stamping out individual, irregular-shaped metal guy wire guards has simply been recognized as old-fashioned, costly, and inefficient for modern day requirements. Further, the Hocher and Elliott guy wire guards suffer from the same material-wasting disadvantages as discussed above.

Another problem encountered with present day guy wire guards is the requirement that they be provided in a plurality of different shapes and sizes in order to accommodate each of the plurality of differently sized guy wire anchor assemblies. Presently utilized anchor assemblies range in size from a small half-inch diameter clamp to a relatively large 2½ inch diameter flat plate anchor. To economize material usage, differently sized guy wire guards and/or connecting clamps are necessary for each different installation which, obviously, complicates manufacturing and increases inventory requirements.

A further requirement of most of the prior art guy wire guards is that in order to be installed, they must be secured to the guy wire by suitable clamps, such as the clamp set forth in U.S. Pat. No. 3,999,340, assigned to the same assignee as the present invention. While provision of such clamps is well-known, they are generally not designed to secure the guy guard to the anchor assembly itself. However, the guy wire guard should if possible encompass, enclose and be secured to the guy wire anchor in order to provide even better protection against interference from animals and/or people.

OBJECTS AND SUMMARY OF THE INVENTION

It is therefore a primary object of the present invention to provide a novel and unique guy wire guard, and method for its manufacture and use, which overcomes all of the deficiencies noted above with respect to the prior art devices.

Another object of the present invention is to provide a novel and unique guy wire guard which achieves a substantial material savings as compared with prior art designs.

An additional object of the present invention is to provide a unique guy wire guard design which may be manufactured in a single universal size so as to fit substantially all guy wire installations.

A still further object of the present invention is to provide a novel technique for manufacturing plastic guy wire guards which imparts a memory characteristic to the plastic guard that permits a simple, straightforward and secure installation in the field.

A still additional object of the present invention is to provide a novel manufacturing technique for guy wire guards made of plastic which enables a universal size guard to be utilized for a variety of sizes of guy wire installations, and which concomitantly ensures that the guy wire guard may be easily, simply and securely installed over an anchor assembly without requiring special tools or additional field work.

A still further object of the present invention is to provide a manufacturing process for plastic guy wire guards which may be continuously performed to achieve highly efficient mass production of the desired end product.

Another object of the present invention is to provide a novel method for the manufacture of a plastic guy wire guard which results in a product having an inherent memory characteristic which, in turn, provides a novel and unique method of installing the guard over a guy wire assembly.

The foregoing and other objects are attained in accordance with one aspect of the present invention through the provision of a method for manufacturing a plastic guy wire guard, which comprises the steps of forming a cylindrical tube having a substantially constant diameter along its entire length, slitting the tube longitudinally along its entire length, and flaring one end of the slit tube. The forming step may be accomplished by extruding molten plastic through a die at a first temperature and then cooling the extruded plastic, whereby the cylindrical tube is formed with an initial memory characteristic. In a preferred embodiment, the flaring step is comprised of the steps of heating one end of the slit tube to a second temperature, which is below the first temperature, and then positioning the heated end about a flared mandrel. The flaring step further includes the steps of applying pressure to the heated end of the tube when it is placed about the flared mandrel, and then cooling the flared end while it is in position on the mandrel.

In accordance with yet other aspects of the present invention, a novel method is provided for installing the plastic guy wire guard, which is manufactured according to the above-stated process, onto a guy wire installation that includes a relatively small diameter guy wire and a relatively large diameter anchor assembly for connecting the guy wire to the ground. The installation technique includes the steps of positioning the constant diameter, unflared portion of the tube about the guy wire, and then positioning the flared end about the anchor assembly. The technique further comprises the step of securing the flared end to the anchor assembly by causing the flared end to contract in diameter towards that defined by the initial memory characteristic until the anchor assembly is substantially enclosed by the flared end. The flared end may be caused to contract by applying heat to the flared end, the heat being applied either by exposure to sunlight over a period of time, or by applying a heat source to the flared end immediately after being positioned about the anchor assembly, the heat source being at a third temperature which is lower than the first temperature at which the tube was initially formed.

In accordance with still other and further aspects of the present invention, there is provided a rigid plastic guy wire guard, which comprises an elongated plastic tube having a substantially cylindrical, constant diameter portion for enclosing most of a guy wire, an increased diameter portion formed at one end of the tube for enclosing the anchor of the guy wire, and a transition portion which interconnects the constant diameter portion and the increased diameter portion. The transition portion rapidly tapers from the constant diameter portion to the increased diameter portion. The elongated plastic tube is preferably slit from one end to the other so as to form two opposed longitudinal edges which are substantially adjacent one another in the constant diameter portion, which are substantially parallel but spaced from one another in the increased diameter portion, and which form a V-shape in the transition portion. More particularly, the transition portion and the increased diameter portion tend to contract in diameter towards the diameter of the constant diameter portion upon exposure to heat.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a perspective view of a plastic tube formed in the early phases of the process of the present invention;

FIG. 2 is a perspective view of the tube of FIG. 1 but shown after an additional step of the present inventive technique has been performed;

FIG. 3 is a perspective view which illustrates the plastic guy guard of the present invention as initially installed during one phase of the present technique in accordance with the present invention; and FIG. 4 is a view of the same installation shown in FIG. 3 but illustrated after an additional step of the present technique has been performed.

DETAILED DESCRIPTON OF THE PREFERRED EMBODIMENTS

Referring now to the drawings, wherein like reference numerals represent identical or corresponding parts throughout the several views, and more particularly to FIG. 1 thereof, there is illustrated a substantially cylindrical tubular member 10 initially formed in the first step of the manufacturing technique according to the present invention. Tube 10 preferably is formed by any well-known extrusion, casting, or molding technique with a substantially constant diameter along its entire length (typically 7 feet) from one end 12 to its other end 14. The diameter of tube 10 is preferably just sufficient to accommodate the ¼ to ½ inch diameter cable that is provided in a typical guy wire installation. The tube 10 may consist of any of a number of suitable rigid plastic materials, such as polyvinylchloride (PVC), polyethylene, or ethylene copolymers. For many applications, special PVC tubing which has been impact modified, UV stabilized, and weather-screened is preferred.

The initial tube-forming step of one aspect of the present invention may be carried out, by way of example, as follows. Polyethylene may be initially provided in the form of either finely ground powder or as small plastic pellets which are heated to a melt temperature of approximately 400° F., agitated and extruded through a suitably shaped die to form round, uniform cross-section tubing. The tubing is immediately quenched in a cooling liquid, such as water, and is cut to desired lengths to form a plurality of tubular members, such as tube 10 of FIG. 1. The tube 10 is then cut longitudinally so as to form a slit 16 comprised of a pair of opposed and adjacent edges. The basic function of the slit 16 is to create an opening for later installation of the tube 10 about a guy wire.

After the above-described initial forming step has been accomplished, the tube 10 has an inherent memory characteristic. That is, after the plastic has been melted and cooled to room temperature, the tube 10 has the ability to maintain and remember its basic shape as illustrated in FIG. 1, and will tend to return to that basic shape even if subsequently deformed, in a manner to be described in more detail hereinafter.

In the next step of one aspect of the present inventive technique, one end of the tube 10 is flared by either hot or cold forming on a mandrel. Continuing the above example, a heat source is applied to one end 14 of the polyethylene tube 10 to raise its temperature to about 250° F., which is below the temperature at which the tube 10 was initially formed. After heating, the end 14 is slipped over a flared mandrel having the form of the preferred shape for the finished product. A stamping press cover then is closed over the heated end of the tube to press same into the desired shape. The press is preferably provided with a water cooled jacket in order that the flared end 24 (FIG. 2) may be cooled while still on the mandrel.

The end product, illustrated in FIG. 2, consists of a substantially rigid, plastic guy guard 100 and includes a constant diameter portion 22 which has the same diameter as the tube 10 orginally formed, a flared or enlarged diameter end 24, and a rapidly tapering neck or transition portion 20 which connects the constant diameter portion 22 with the enlarged diameter end portion 24. Typically, with a guy guard 100 about seven feet in overall length, the flared end 24 along with neck portion 20 are about 2 feet long.

The neck or transition portion 20 of guard 100 may be defined in terms of edges 26 and 28 which are now V-shaped and consist of the edges which were previously adjacent as defined by slit 16 of tube 10. V-shaped edge portions 26 and 28 terminate in substantially parallel, spaced edge portions 36 and 38, respectively of the flared or enlarged diameter end portion 24. In this fashion, the flared end 24 of the guy guard 100 is formed into an enlarged diameter tubular portion which is of sufficient size so as to accommodate the largest of the guy wire anchor assemblies presently utilized.

In a typical guy wire anchor installation, illustrated in FIG. 3, the guy wire 30 extends through a parallel anchor plate 40 and around a ground-embedded cable anchor 50 as illustrated, all of which is conventional. The top portion of the guy wire 30 is clamped to itself as by a wire clamp 32. During installation of the guy guard 100, the constant diameter portion 22, sized so as to just accommodate the guy wire 30, is fitted thereabout, while the flared portion 24 is positioned about the lower anchor assembly.

The guy guard 100, formed as illustrated in FIG. 2, is substantially rigid and, if formed of PVC, has a very long shelf life. If formed of a polyethylene base, the flared or enlarged portion 24 may tend to naturally contract in diameter towards that of the original constant diameter portion 22. This is due to the inherent memory characteristic imparted during the initial formation of tube 10.

Thus, for certain materials, such as polyethylene, the flared or enlarged diameter portion 24, as a result of normal processes or by simple exposure to sunlight, will contract in diameter to assume the shape illustrated in FIG. 4. This contraction in diameter results from the loosening of its molecular structure, which can be aided by the application of heat, that permits the flared portion 24 to reduce its size towards the diameter of the initially formed lower diameter memory portion 22. This contraction may or may not require the application of heat by the installer at the time of installation, depending upon the type of material of which tube 10 is formed. I have found, for example, that with a polyethylene guy wire guard 100, application of a heat source of about 200° F. over the entire periphery of flared portion 24 will result in the desired reduction in diameter at the time of installation. The temperature of the heat source used in this step must be less than that at which tube 10 was initially formed.

The enlarged diameter portion 24 will contract so as to substantially and tightly enclose about three-fourths of the periphery of components 40 and 50 as illustrated in FIG. 4. This not only effectively protects the anchor assemblies against animal and/or human interference, but serves as a means for securing the bottom of guy guard 100 to the guy wire installation, thereby obviating the need for additional clamps or installation tools. For those anchor assemblies smaller in size than that illustrated in FIGS. 3 and 4, the flared portion 24 will upon application of heat continue to contract towards its original diameter, as defined by the memory characteristic initially imparted to tube 10, until the anchor hardware is contacted by the inner walls of the reducing diameter flared portion.

The shape of the guy guard 100 of the present invention is inherently material saving, in that the constant small diameter portion 22 is just sufficient so as to accommodate the small diameter wire or cable, while the flared portion 24 is in fact made of the same amount of material as was used to make the end of the original small diameter tube 10 from which the enlarged diameter portion 24 was formed. The fact that no extra material is required to form the enlarged diameter end 24 results in its unique open circumference, partially enclosing structure clearly illustrated in FIG. 2 wherein the edges 36 and 38 are substantially parallel but spaced from one another. This design results from recognition of the fact that it is not necessary to completely encase the anchor assembly in order to properly protect it and secure the guard, but that, with the unique above-described memory characteristics of the plastic guy guard, only one-half to three-quarters of complete coverage is needed.

Accordingly, installation of the guy guard 100 of the present invention is greatly facilitated, and in some cases, no special tools are necessary, the self-enclosing action of the flared end 24 being aided and/or accomplished by normal solar radiation. Only a single size tube need be made, owing to the unique ability of the flared end 24 to conform to virtually any size anchor assembly. Furthermore, manufacturing techniques are extremely efficient in that a regularly shaped tube 10 as illustrated in FIG. 1 is initially formed, thereby permitting continuous mass production. The material and labor savings over the prior art devices and techniques are substantial.

Obviously, numerous modifications and variations of the present invention are possible in light of the above teachings. It is therefore to be understood that within the scope of the appended claims, the invention may be practiced otherwise than as specifically described herein.

I claim as my invention:

1. A method of installing a plastic tube having a substantially constant diameter unflared portion and a heat shrinkable flared end onto a guy wire installation having a relatively small diameter guy wire and a relatively large diameter anchor assembly for connecting said guy wire to the ground, which comprises the steps of positioning the constant diameter, unflared portion of said tube said guy wire, positioning said flared end about said anchor assembly and applying heat to said flared end.

2. The method as set forth in claim 1, wherein said heat applying step comprises the step of securing said flared end to said anchor assembly.

3. The method as set forth in claim 2, wherein said step includes the step of causing said flared end to contract in diameter until said anchor assembly is substantially enclosed thereby.

4. The method as set forth in claim 1, wherein said heat applying step includes the step of exposing said flared end to sunlight over a period of time.

5. The method as set forth in claim 1, wherein said heat applying step includes the step of blowing hot air on said flared end portion immediately after said flared end positioning step has been performed. diameter mouth portion containing from said rapidly tapering neck portion, said mouth portion defined by said two longitudinal edges formed in a substantially parallel spaced fashion between the end of said rapidly tapering neck portion and said end of said flared portion of said tube.

6. A rigid plastic guy wire guard, which comprises:

an elongated plastic tube having a substantially cylindrical constant diameter portion for enclosing most of a guy wire, an increased diameter portion formed at one end of said tube for enclosing the anchor of said guy wire, and a transition portion interconnecting said constant diameter portion and said increased diameter portion.

7. A rigid plastic guy wire guard as set forth in claim 6, wherein said transition portion rapidly tapers from said constant diameter portion to said increased diameter portion.

8. A rigid plastic guy wire guard as set forth in claim 7, wherein said elongated plastic tube is slit from one end to the other so as to form two opposed longitudinal edges which are substantially adjacent one another in said constant diameter portion, are substantally parallel but spaced from one another in said increased diameter portion, and which form a V in said transition portion.

9. A rigid plastic guy wire guard as set forth in claim 8, wherein said transition portion and said increased diameter portion tend to contract in diameter towards the diameter of said constant diameter portion upon exposure to heat.

10. A rigid plastic guy wire guard as set forth in claim 8, wherein said increased diameter portion includes means for causing same to contract towards the diameter of said constant diameter portion.

11. A method of installing a plastic guy wire guard on a guy wire installation, said installation including a relatively small diameter guy wire and a relatively large diameter anchor assembly for connecting said guy wire to the ground, said plastic guy wire guard including a relatively small diameter elongated slit tube sufficient to accommodate said guy wire, and a relatively large diameter integrally formed flared end portion sufficient to accommodate said anchor assembly, which comprises the steps of positioning said plastic guy wire guard such that said small diameter tube encompasses said guy wire and said flared end portion is positioned around said anchor assembly, and securing said guard to said installation by causing said flared end portion to contract in diameter until said anchor assembly is substantially enclosed thereby.

12. A method of installing a plastic guy wire guard on a guy wire installation as set forth in claim 11, wherein said step of causing said flared end portion to contract in diameter comprises the step of applying heat to said flared end portion.

13. A method of installing a plastic guy wire guard on a guy wire installation as set forth in claim 12, wherein said step of applying heat to said flared end portion includes the step of exposing said flared end portion to sunlight over a period of time.

14. A method of installing a plastic guy wire guard on a guy wire installation as set forth in claim 12, wherein said heat applying step includes the step of blowing hot air on said flared end portion immediately after said positioning step has been performed.

15. A guy wire guard, which comprises:

an elongated, substantially homogeneous, rigid plastic tubular member slit along its entire length and having a substantially cylindrical constant diameter portion formed at one end thereof, a substantially cylindrical increased diameter heat recoverable portion formed at the other end thereof, and a tapered transition portion interconnecting said constant diameter portion and said increased diameter portion.

16. The guy wire guard as set forth in claim 15, wherein said rigid plastic tubular member further comprises a pair of edges defined by said slit that extend longitudinally along said member from one end to the other thereof said edges being substantially adjacent one another in said constant diameter portion, opposed but spaced from one another in said increased diameter portion, and which diverge in said transition portion.

17. The guy wire guard as set forth in claim 15, wherein said constant diameter portion of said tubular member is not heat-shrinkable.

* * * * *